United States Patent [19]

Weeks

[11] 4,230,224

[45] Oct. 28, 1980

[54] CIGARETTE AND LIGHTER CASE

[76] Inventor: Patrick W. Weeks, 47-360 F Hui Iwa St., Kaneohe, Hi. 96744

[21] Appl. No.: 12,711

[22] Filed: Feb. 16, 1979

[51] Int. Cl.[3] ..... A24F 15/10; B65D 85/10

[52] U.S. Cl. ..... 206/87; D27/38; 206/94

[58] Field of Search ..... D27/37–38, D27/49; 131/185; 206/85, 87, 94, 101

[56] References Cited

U.S. PATENT DOCUMENTS

| | | | |
|---|---|---|---|
| 1,689,479 | 10/1928 | Conklin | 206/94 |
| 2,116,963 | 5/1938 | Aronson | 206/87 |
| 3,057,180 | 10/1962 | Steppan | D27/37 X |
| 3,763,996 | 10/1973 | Shepherd | 206/87 |
| 4,000,812 | 1/1977 | Pisarski et al. | 206/87 |

FOREIGN PATENT DOCUMENTS

| | | | |
|---|---|---|---|
| 983379 | 2/1951 | France | 206/87 |
| 1292446 | 3/1962 | France | 206/87 |
| 1297791 | 5/1962 | France | 206/87 |
| 1432121 | 2/1966 | France | 206/87 |

*Primary Examiner*—Herbert F. Ross

*Attorney, Agent, or Firm*—LeBlanc, Nolan, Shur & Nies

[57] ABSTRACT

A combination cigarette and lighter case is provided in which a lighter holder is removably mounted on a cigarette case. The lighter holder comprises a tubular member of non-rigid material adapted to fit snugly about the cigarette lighter. The lighter holder is especially suitable for use with disposable cigarette lighters of various configurations. The cigarette case and lighter holder are provided with a set of fasteners which allow the lighter holder to be conveniently engaged and disengaged. Preferably, with the lighter holder secured to the cigarette case, the lid of the cigarette case is held closed.

5 Claims, 9 Drawing Figures

CIGARETTE AND LIGHTER CASE

The present invention relates to a combination cigarette and lighter case and, more particularly, to a cigarette case provided with a removable lighter holder. Specifically, this invention relates to a combination cigarette and lighter case provided with a lighter holder which is conveniently removable from the cigarette case and suitable for use with conventional disposable lighters.

Various cigarette cases have been developed in the prior art which are adapted to hold both a pack of cigarettes and a cigarette lighter. These combination cigarette and lighter cases have proved convenient for use by smokers because the cigarette lighter is maintained in close proximity to the cigarettes to be lit. See, for example, U.S. Pat. No. 3,763,996, which discloses a cigarette case adapted to magnetically hold a conventional cigarette lighter with a metallic case. Another combined cigarette and lighter case is shown in U.S. Pat. No. Des. 113,448.

The recent development and widespread popularity of disposable cigarette lighters has led to the need for improvements over previous cigarette and lighter cases to accommodate the new disposable lighters. Since these disposable lighters tend to be constructed of plastic material, the previously used magnetic holding arrangement is useless for such lighters. For example, it is has been proposed to provide a cigarette pack which incorporates a disposable cigarette lighter, as shown in U.S. Pat. No. 3,976,194. Separate cases for disposable cigarette lighters have also been proposed, as shown in U.S. Pat. Nos. 3,999,937 and 4,011,040.

In addition, new commercial designs for cigarette and lighter cases have been developed which incorporate integrally mounted lighter holders for receiving and storing disposable cigarette lighters. However, these designs have been somewhat inconvenient to use because of the necessity to remove the cigarette lighter from its holder to light a cigarette and to subsequently replace the lighter in the holder. Moreover, such cases have been designed merely to loosely receive the cigarette lighter in the holder. Thus, in actual use and handling of the cigarette case, there is a tendency for the cigarette lighter to become separated from the case.

The present invention contemplates an improved combination cigarette and lighter case provided with a lighter holder which is especially suitable for use with conventional disposable lighters. The lighter holder is adapted to snugly receive and firmly retain the cigarette lighter therein. Moreover, the lighter holder is conveniently removable from the cigarette case when it is desired to light a cigarette. The holder is also firmly secured to the lighter case when the cigarette lighter is not in use.

In accordance with the invention, the combination cigarette and lighter case comprises a cigarette case adapted to receive a pack of cigarettes, a lighter holder adapted to receive a cigarette lighter, and means for removably securing the lighter holder to the cigarette case. The lighter holder preferably comprises a tubular member of nonrigid material adapted to fit snugly about the cigarette lighter. Preferably, the securing means comprises a first set of fasteners on the cigarette case releaseably engageable with a second set of fasteners on the lighter holder. The sets of fasteners may comprise a plurality of Velcro elements, snap fasteners, hooks and eyes, or magnets and magnetically attractable elements, or other suitable fastening devices.

In a preferred embodiment of the invention, the cigarette case includes a lid movable between open and closed positions. The cigarette case and lid are provided with means for removably securing the lighter holder and holding the lid closed when the lighter holder is secured to the case. Preferably, the securing means comprises a first set of fasteners on the cigarette case, one of the fasteners being located on the lid, and a second set of fasteners on the lighter holder releaseably engageable with the first set of fasteners to secure the lighter holder to the lid and cigarette case.

The invention is also embodied in a holder for a cigarette lighter comprising a tubular member of nonrigid material adapted to fit snugly about the cigarette lighter. The tubular member is preferably formed of flexible material which provides a sheath-like holder adapted to conform to the external shape of the cigarette lighter. The tubular member or sheath may have an open or closed bottom end and, if desired, may incorporate nonslip material inside to more firmly retain the cigarette lighter in the sheath.

Accordingly, it is an object of this invention to provide a combination cigarette and lighter case incorporating a removable lighter holder.

It is also an object of the invention to provide a combination cigarette and lighter case in which the removable lighter holder is suitable for use with conventional disposable cigarette lighters.

Another object of the invention is to provide a combination cigarette and lighter case including a removable lighter holder which is adapted to maintain the lid of the cigarette case closed when the lighter holder is secured to the cigarette case.

A further object of the invention is to provide an improved lighter holder for a disposable cigarette lighter which is adapted to fit snugly about the lighter and firmly retain the lighter therein.

These and other objects will be readily apparent with reference to the drawing and following description wherein.

Figure 1:
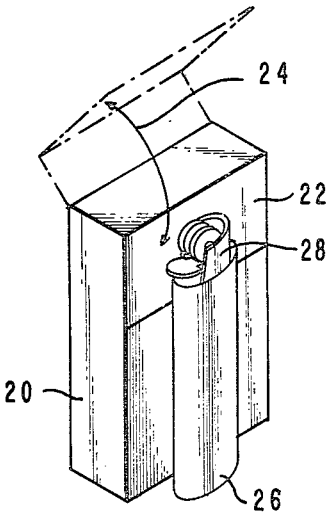
FIG. 1 is a perspective view of a cigarette case provided with a flip top and a removable lighter holder mounted on the front of the cigarette case.
Figure 2:
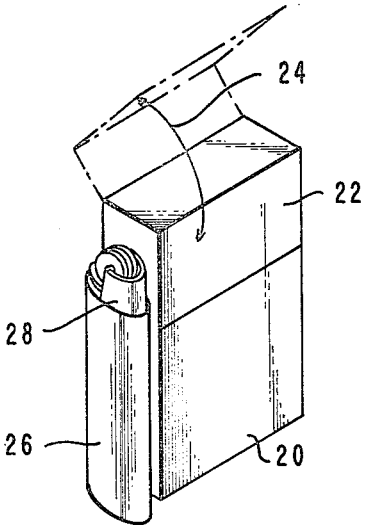
FIG. 2 is a perspective view of a cigarette case provided with a flip top and a removable lighter holder mounted on the side of the cigarette case.

Referring to FIG. 1, a combination cigarette and lighter case includes a cigarette case 20 which is generally rectangular in configuration and adapted to receive a pack of cigarettes (not shown). Cigarette case 20 includes a lid 22 which can be flipped between open and closed positions as indicated by arrow 24. Preferably, the cigarette case is constructed of nonrigid material, e.g., leather, plastic, cloth, vinyl or woven straw.

The combination cigarette and lighter case includes a lighter holder 26 which is adapted to receive a disposable cigarette lighter 28. Preferably, lighter holder 26 consists of a tubular member or sheath of nonrigid material adapted to fit snugly about cigarette lighter 28. Preferably, tubular sheath 26 is made of flexible material such as leather, plastic, cloth or vinyl. The bottom end of tubular member 26 may be opened or closed and, if desired, nonslip material may be provided inside to firmly retain cigarette lighter 28 within the lighter holder.

Figure 8:
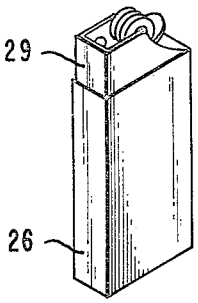
FIG. 8 illustrates the lighter holder adapted to conform to a cigarette lighter having a rectangularly shaped exterior configuration.
Figure 9:
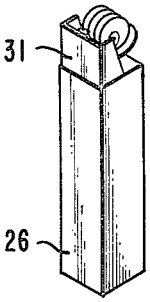
FIG. 9 illustrates the lighter holder adapted to conform to a cigarette lighter having a square-shaped exterior configuration.

As shown in FIG. 1, tubular member or sheath 26 is readily able to conform to the oval exterior configuration of cigarette lighter 28. However, it will be understood by persons skilled in the art that the tubular sheath will also conform to cigarette lighters of other exterior shapes, e.g., a lighter 29 (FIG. 8) of rectangular shape or a lighter 31 (FIG. 9) of square shape.

Figure 4:
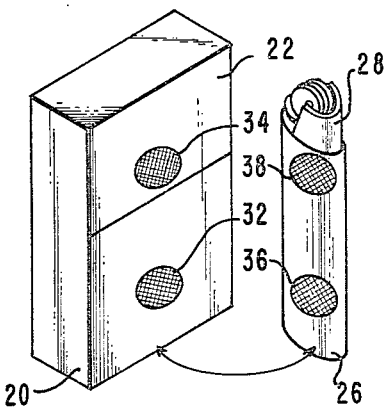
FIG. 4 illustrates the use of Velcro fastening elements to removably secure the lighter holder to the cigarette case.

The combination cigarette and lighter case includes means for removably securing the lighter holder to the cigarette case. Preferably, the securing means comprises a first set of fasteners on the cigarette case which is releasably engageable with a second set of fasteners on the lighter holder. For example, as shown in FIG. 4, a first set of Velcro fastening elements 32 and 34 may be provided on the front surfaces of cigarette case 20 and lid 22, respectively. A corresponding pair of Velcro elements 36 and 38 may be provided on lighter holder 26 which are engageable with Velcro elements 32 and 34, respectively, to secure the lighter holder to the cigarette case and lid. Thus, with lighter 26 secured in place, lid 22 is held closed. Alternatively, fastening element 34 may be mounted on the front surface of cigarette case 20 and lid 22 may be provided with an opening which allows this fastening element to engage fastening element 38 on lighter holder 26 when the lid is closed.

Figure 5:
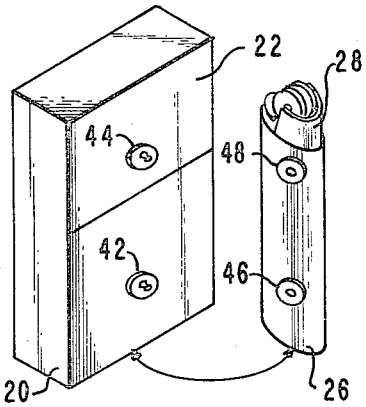
FIG. 5 illustrates the use of snap fasteners to removably secure the lighter holder to the cigarette case.

Other types of fasteners may be employed on the combination cigarette and lighter case. For example, as shown in FIG. 5, a first set of snap fasteners 42 and 44 may be provided on the front surfaces of cigarette case 20 and lid 22 for engagement with a corresponding set of snap fasteners 46 and 48 provided on lighter holder 26. Alternatively, snap fastener 44 may be mounted on the front surface of cigarette case 20 and lid 22 may be provided with an opening which allows it to engage snap fastener 48 on the lighter holder.

Figure 6:
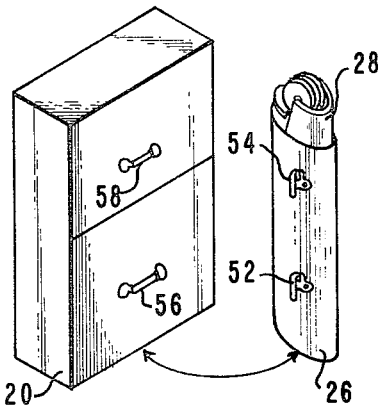
FIG. 6 illustrates the use of hooks and eyes to removably secure the lighter holder on the cigarette case.

Another embodiment (FIG. 6) incorporates a pair of hooks 52 and 54 mounted on lighter holder 26 for engagement with a pair of eyes 56 and 58, respectively, mounted on the back of cigarette case 20.

Figure 7:
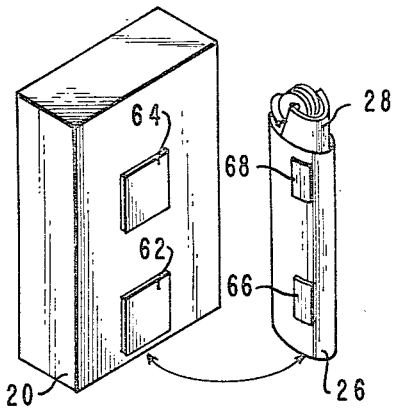
FIG. 7 illustrates the use of magnets and magnetically attractable elements to removably secure the lighter holder to the cigarette case.

A further embodiment (FIG. 7) incorporates a pair of magnets 62 and 64 mounted on the back of cigarette case 20 and a pair of magnetically attractable elements 66 and 68 mounted on lighter holder 26.

Figure 3:
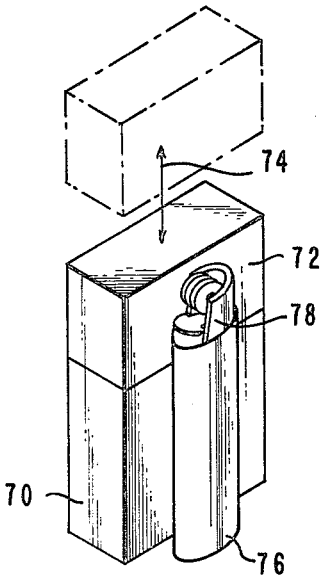
FIG. 3 is a perspective view of a cigarette case provided with a lift-off lid and a lighter holder removably mounted on the front of the cigarette case.

Referring to FIG. 3, an alternative embodiment of the cigarette and lighter case incorporates a generally rectangular cigarette case 70 provided with a lid 72 which is completely removable as indicated by arrow 74. A lighter holder 76 adapted to receive a disposable cigarette lighter 78 may be mounted on the front or rear of cigarette case 70 by appropriate fasteners. With lighter holder 76 secured in place, lid 72 is held closed.

In conclusion, the present invention provides a combination cigarette and lighter case which conveniently allows a disposable cigarette lighter to be stored with a pack of cigarettes. The cigarette lighter holder is firmly attached to the cigarette case when the lighter is not in use. The cigarette lighter and holder are readily removable from the cigarette case when it is desired to light a cigarette. In the preferred embodiment, the lighter holder also serves to maintain the lid of the cigarette case closed when the lighter holder is secured to the case.

While a specific embodiment of the invention has been shown and described in detail, it will be understood that the invention may be modified without departing from the spirit of the inventive principles as set forth in the appended claims.

What is claimed is:

1. A combination cigarette case and lighter case, comprising:

a cigarette case adapted to receive a package of cigarettes, said case including a lid movable between open and closed positions;

a tubular lighter case of non rigid material adapted to receive a cigarette lighter and to fit snugly thereround; and means for removably securing said lighter case to said cigarette case and for holding said lid in a closed position comprising a first set of fasteners carried by the cigarette case and a co-operable first set of fasteners carried by said lighter case; and a second set of fasteners carried by said lid and a co-operable second set of fasteners carried by said lighter case said first sets and second sets of fasteners being releasably engageable so that when said sets are engaged the lighter and said lighter case will be secured to said cigarette case and said lid will be held in a closed position.

2. The combination cigarette and lighter case of claim 1, wherein:

said first and second sets of fasteners comprise a plurality of Velcro elements.

3. The combination cigarette and lighter case of claim 1, wherein:

said first and second sets of fasteners comprise a plurality of snap fasteners.

4. The combination cigarette and lighter case of claim 1, wherein:

said first and second sets of fasteners comprise a plurality of hooks and eyes.

5. The combination cigarette and lighter case of claim 1, wherein:

said first and second sets of fasteners comprise a plurality of magnets and magnetically attractable elements.

* * * * *